US006510863B1

(12) United States Patent
Traylor

(10) Patent No.: US 6,510,863 B1
(45) Date of Patent: Jan. 28, 2003

(54) DUAL INLET AIR GAP

(76) Inventor: Paul L. Traylor, 2691 Richter, Suite 113, Irvine, CA (US) 92606

( * ) Notice: Subject to any disclaimer, the term of this patent is extended or adjusted under 35 U.S.C. 154(b) by 0 days.

(21) Appl. No.: 09/872,987

(22) Filed: Jun. 1, 2001

(51) Int. Cl.[7] ..... E03C 1/12
(52) U.S. Cl. ..... 137/216; 137/216.1
(58) Field of Search ..... 137/216, 216.1

(56) References Cited

U.S. PATENT DOCUMENTS

| | | | |
|---|---|---|---|
| 2,878,826 | A | 3/1959 | Dolenga |
| 3,183,923 | A | 5/1965 | Henrikson |
| 3,620,241 | A | 11/1971 | Brown |
| 3,716,143 | A | 2/1973 | Clark |
| 3,786,924 | A | 1/1974 | Huffman |
| 3,856,672 | A | 12/1974 | Boswinkle et al. |
| 3,929,149 | A | 12/1975 | Phillips |
| 3,967,638 | A | 7/1976 | Tondreau |
| 4,071,445 | A | 1/1978 | Katayama et al. |
| 4,134,419 | A | 1/1979 | Richetti |
| 4,454,891 | A | 6/1984 | Dréibelbis et al. |
| 4,646,775 | A | 3/1987 | Traylor |
| 4,771,485 | A | 9/1988 | Traylor |
| 4,812,237 | A | 3/1989 | Cawley et al. |
| 4,856,121 | A | 8/1989 | Traylor |
| 4,917,847 | A | 4/1990 | Solomon |
| 4,944,877 | A | 7/1990 | Maples |
| 4,967,784 | A | 11/1990 | Barhydt, Sr. et al. |
| 5,006,234 | A | 4/1991 | Menson et al. |
| 5,176,165 | A | 1/1993 | Traylor |
| 5,305,778 | A | 4/1994 | Traylor |
| 5,713,385 | A | 2/1998 | Traylor |

*Primary Examiner*—Gerald A. Michalsky
(74) *Attorney, Agent, or Firm*—Joseph F. McLellan

(57) ABSTRACT

A dual inlet air gap having an air gap body comprising a pair of inlet ports having substantially the same size, rate of flow, and pressure drop to accept waste water flow from a pair of waste water sources for emptying into a single outlet port located between the pair of waste water sources.

30 Claims, 5 Drawing Sheets

(C/L) LOCATION
(F/L) LOCATION
40
70
28
66
30
38
52
48
24
31
31
23
60
58
56
39
16
14
48
17
17
22
42
43
34

DUAL INLET AIR GAP

BACKGROUND OF THE INVENTION

1. Field of the Invention

The present invention relates to an air gap particularly adapted to vent the waste water discharge from one or more household dishwashers and the waste water discharge from a reverse osmosis (RO) system.

2. Description of the Prior Art

Most plumbing codes specify that an anti-siphon device or air gap be provided to vent waste water discharge from household primary waste water sources such as dishwashers and the like. The air gap includes a vent chamber or space through which the waste water passes. This space is vented to atmosphere to prevent the establishment of a vacuum that could result in back siphoning of the contaminated dishwasher water back into the household water supply system.

Many prior art "single inlet" air gaps are capable of venting the waste water discharge from a single primary source such as a dishwasher or the like.

One such single inlet air gap has come into such widespread use that it has become more or less standard in the trade. The air gap body is molded or otherwise formed of plastic material into a unitary or one-piece structure which includes a central leg constituting an outlet conduit or port that discharges all of the waste water coming from the air gap body into a household drain line for emptying into the sewer. The air gap body also includes a laterally divergent leg constituting a single inlet conduit or port through which waste water enters the air gap body.

The inlet port of the single inlet air gap body is clamped or otherwise attached to a dishwasher hose to receive the dishwasher waste flow and pass it to the air gap body. The discharge port of the air gap body empties all waste from the air gap body to a sewer pipe or the like via a household garbage disposer, if there is one, or directly to a household drain line connected to the sewer pipe.

Waste water entering through the inlet port from a dishwasher or from an RO drain line passes upwardly through the air gap body, where a flow diverter at the top of the body reverses the direction of waste flow downwardly through a space or spaces located interiorly of the air gap body for venting to atmosphere. Such venting prevents development of a vacuum that might cause suction or back siphoning of waste water into the reverse osmosis (RO) unit and contaminate the household water supply.

Dishwasher waste water is discharged in relatively high volumes and at a relatively high rate of flow. In contrast, waste water flow from an RO system is of relatively low volume and flows at a relatively low rate. Both such low and high volume and rate flow must be vented to prevent back flow or back siphoning of RO waste water flow into the household water system.

There is a need in the prior art for an air gap capable of venting more than one source of waste water. Insofar as applicant is aware, no such air gap is presently available. This is a particular problem where a householder owns two dishwashers or "dishwasher drawers" incorporated in a single dishwasher. Such drawers are generally equivalent to two separate dishwashers, offering flexibility in handling different kinds and sizes of loads, different washing and drying temperatures, and different timing and sequence of operation of the typical dishwasher cycles. Use of an RO system in the household adds yet another source of waste water.

Heretofore the venting of such an installation would require two or more separate air gaps. This would necessitate drilling a large hole or holes in the sink or counter top in addition to the hole already provided for use with one dishwasher. Providing such additional installation holes would be time consuming, expensive, and unsightly.

SUMMARY OF THE INVENTION

According to the present invention, a unitary or one piece twin or dual inlet air gap body is provided which includes multiple inlets for a pair of dishwashers or dishwasher drawers and for an RO unit. All three of these inlets can be vented using an air gap having a pair of inlet ports for receiving multiple flows of waste water.

The present dual inlet air gap is characterized by waste flow and venting passages whose rates of flow and dimensions are very close to those of the single inlet air gap presently in wide use.

The dimensions of the air gap body enable it to be mounted in the standard size sink or counter top hole that is provided for a single inlet air gap. The inlet and outlet conduits have dimensions similar to those of the single inlet air gap so that they can be connected to the same sizes of dishwasher and garbage disposer hoses. In addition, the present dual inlet air gap body is threaded or otherwise adapted to be seated within a single sink or counter top hole in a manner similar to the mounting of the prior art single inlet type of air gap. It is provided with threads or other connection means so that it can be connected to mounting elements like those now used for a single inlet air gap.

Of particular importance is the provision of dual inlet ports which each have an inner diameter like that of a single inlet air gap so that each of the inlet ports can handle the waste flow from one of the dishwasher drawers of the newly emergent dishwasher designs. Further, in the regions where the two inlet ports enter the central portion of the air gap body, their internal walls are optimally curved, formed or shaped to provide a waste flow essentially the same in volume, rate of flow and pressure drop as that of a conventional single inlet air gap.

What has just been said about the characteristics of each dual inlet port is of course true of the upper extremities of the inlet ports which extend upwardly through the air gap body to the flow reversal fitting. These and other modifications enable the present dual air gap to substantially meet the same physical and functional plumbing code requirements that apply to single inlet air gaps.

The dual inlet air gap has also been configured to fit through the same standard sink opening that is provided for a single air gap, to use the same hose fittings and other connections common to a single inlet air gap, and to adjust the venting spaces and passages to vent both discharges from the dual inlet air gap at a rate comparable to the specifications for a single inlet air gap.

Thus, it is an important feature of the present invention that the dual inlet air gap provides separate venting for two dishwashers, or for the two drawers of a single dishwasher, just as would be provided by two separate air gaps. In addition, the water flow and vent passages are sufficiently isolated from each other that there can be no siphoning of contaminated water from one dishwasher to the other and consequent contamination of the household water supply.

It is also a feature of the present invention that the upper extremity of one of the inlet ports, which usually carry only waste water from a dishwasher or the like, can be modified to serve as an RO inlet port for receiving RO waste water.

Such a modification can easily be done by the manufacturer or by the air gap installer. Also, movement of a component of the modified inlet port can be made between a projected position to stop all flow, and a retracted position which allows RO water to flow. The conversion is quickly and easily accomplished and adds a unique capability to the inlet port.

In every respect possible the present dual air gap with its unique cap portion design and unique one-piece main housing design has been made to function like a pair of single inlet air gaps whereby it can be used as a "standard" air gap for universal use in venting a pair of primary waste sources, just as the most popular single air gap now available has become more or less "standard". Moreover, the present dual air gap is not significantly more expensive or complex than a single inlet air gap body.

As above indicated, the RO unit of an RO system, and specifically the drain line tubing, can also be vented by the present dual inlet air gap simultaneously with the venting of two dishwasher drawers. The low volume, low flow character of RO waste discharge permits the use of a relatively small diameter tube for handling the discharge from an RO system, compared to the larger size hose needed for handling the discharge from a dishwasher.

The small size of the tube is advantageous not only because it is smaller and easier to handle, but the tube can be made of a low friction or slippery material so that it can be routed or passed through relatively small openings and passages in the air gap body for communication with the vent chamber used to vent waste flow from the dishwasher. In certain cases where the flow rate or other functional requirements dictate, the RO unit can be provided with its own separate opening and vent chamber.

In situations where the small RO vent openings are located next to a relatively large drainage flow passageway for a dishwasher or the like, the small RO vent opening is sized, shaped and located to maximize venting, but its depth or downward extension is also adjusted so that the RO tube is located deep in the flow passageway. This minimizes the chance that back siphoning in the RO tube might suck dishwasher water up and into the RO unit.

Use of a higher flow chamber thus can enable venting of both the dishwasher and RO waste flows, eliminating any need for installation of another air gap onto the kitchen sink or counter top in addition to the existing air gap for the dishwasher. An extra air gap would be unsightly, expensive, and time consuming to install.

Other objects and features of the present invention will become apparent from the following more detailed description taken in conjunction with the accompanying drawings.

DESCRIPTION OF THE PREFERRED EMBODIMENTS

Applicant's application Ser. No. 09/842473, filed Apr. 26, 2001, entitled "Combination Reverse Osmosis and Air Gap Body", is pertinent to the present application in many respects, and reference is made to that application for details pertinent to the present invention.

Figure 1:
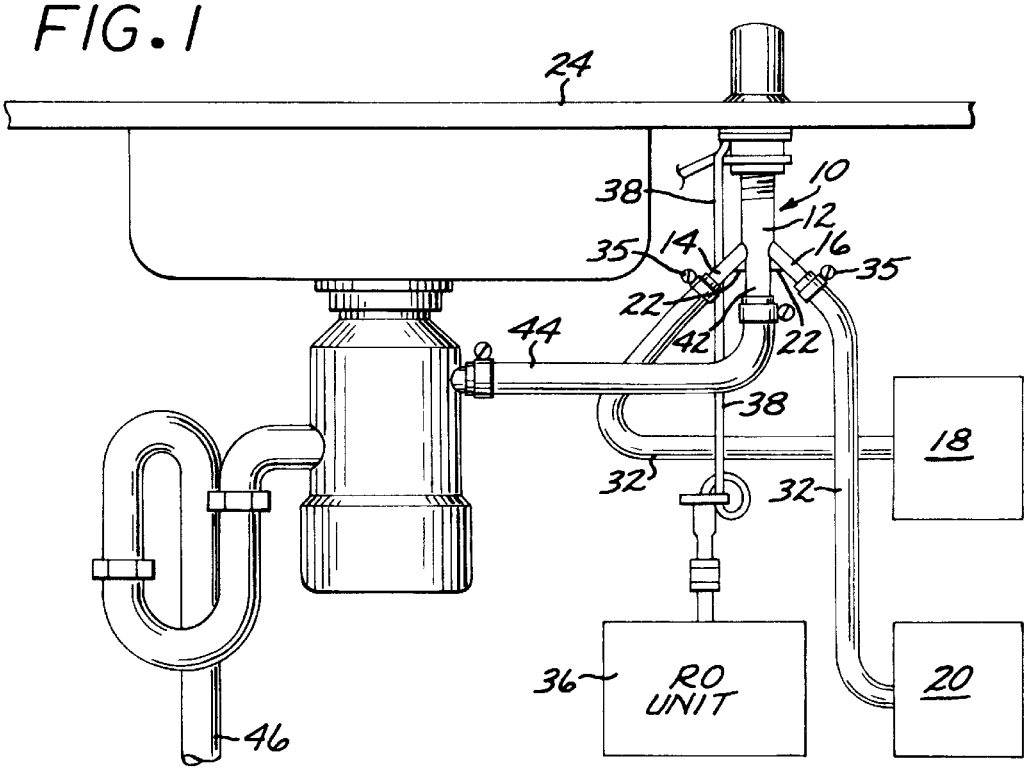
FIG. 1 is a front elevation of one embodiment of the present dual inlet air gap as it would appear when connected to a pair of dishwasher drawers and to an RO unit.
Figure 3:
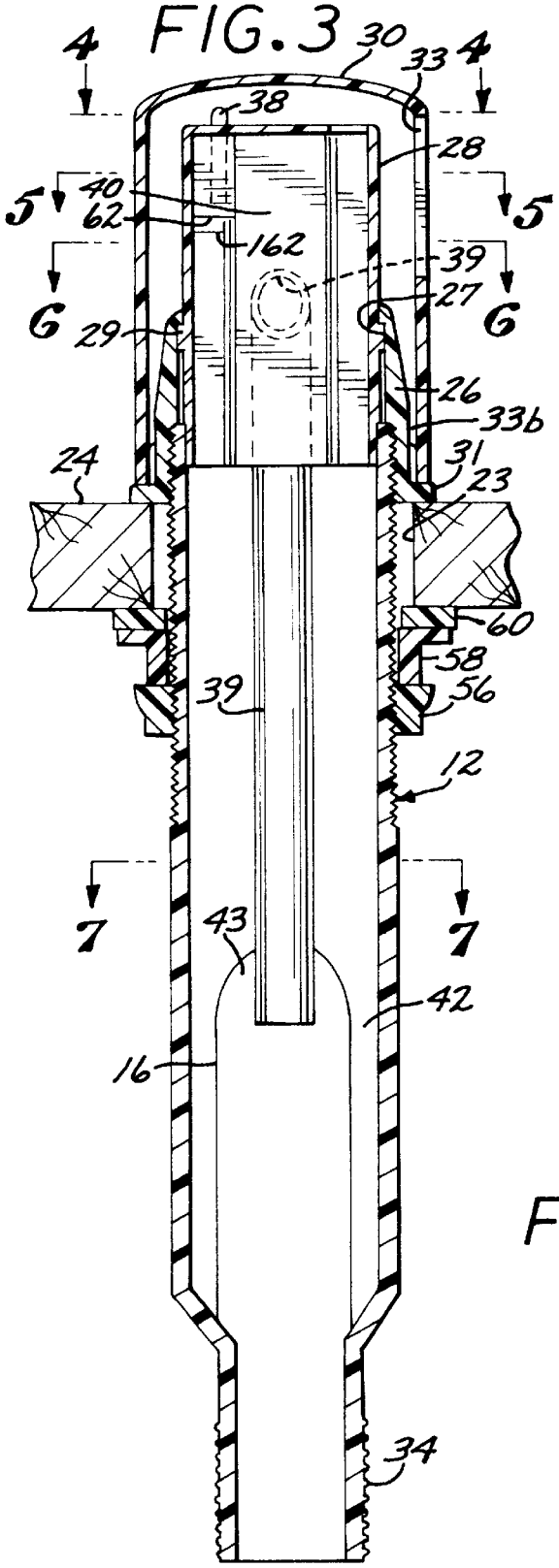
FIG. 3 is an enlarged longitudinal cross sectional view of one side of the dual inlet air gap mounted to a kitchen sink or counter top.
Figure 8:
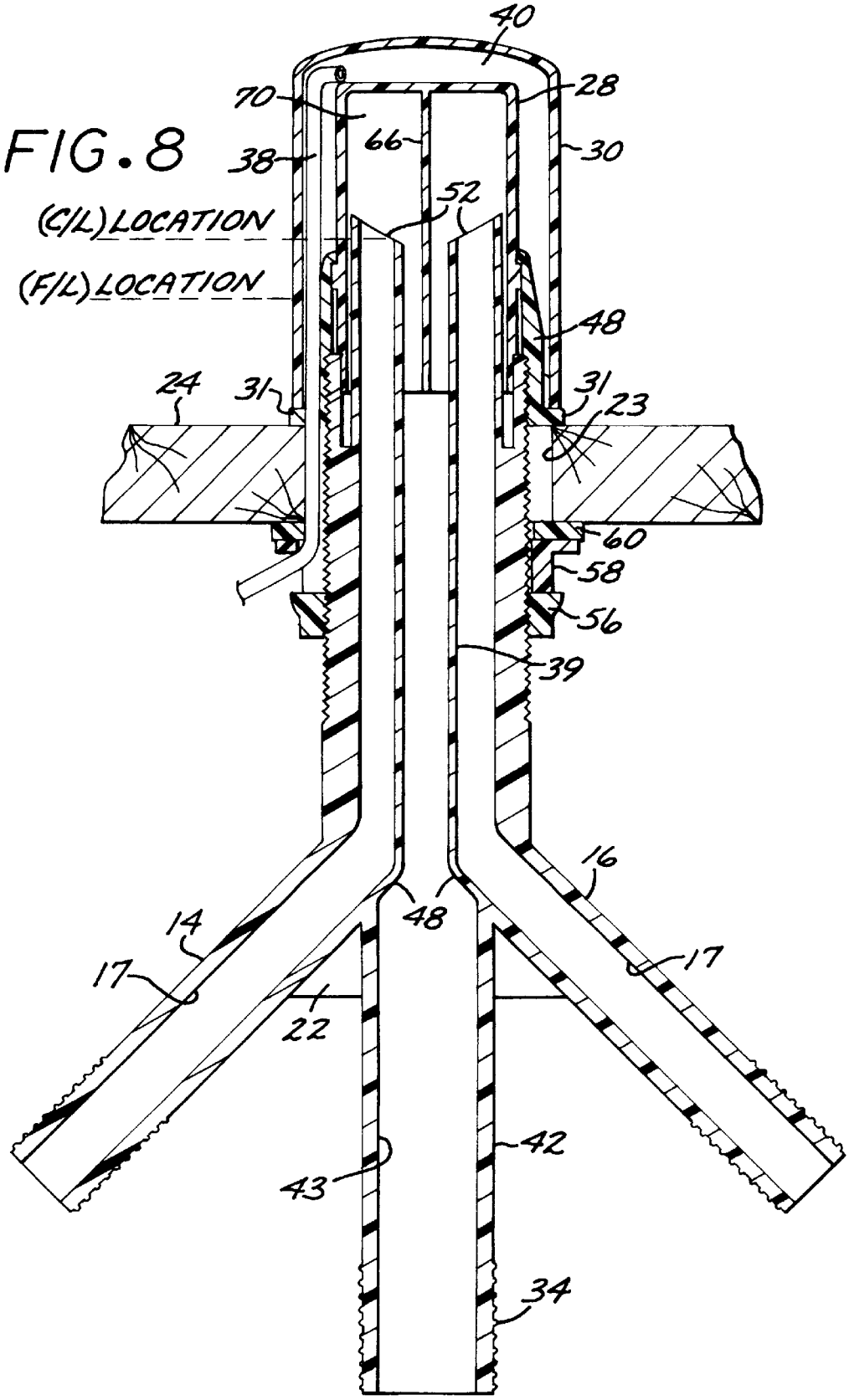
FIG. 8 is an enlarged longitudinal cross sectional view similar to FIG. 3, but illustrating the front of the air gap embodiment of FIG. 1.

Referring now to the drawings, and particularly to FIGS. 1, 3 and 8, a dual inlet air gap 10 is illustrated which comprises a hollow, Y-shaped unitary or one-piece air gap housing or body 12 having an outlet port 42 which includes a central discharge passage 43. It is molded of plastic material and includes integral divergent legs which constitute inlet conduits or ports 14 and 16 for a pair of household dishwasher drawers. The drawers are indicated diagrammatically at 18 and 20.

The inner extremities of the ports 14 and 16 are joined to the body 12 by gussets or braces 22 to strengthen the ports against bending or separation from the body 12. Although the primary waste water sources are identified as dishwasher drawers, they could just as easily be two separate dishwashers or some other pair of primary waste water sources.

The upper extremity of the body 12 is externally threaded, and made approximately 1.25 inches in diameter in order to fit through a slightly larger diameter standard air gap installation hole 23 provided in a kitchen sink or counter top 24. For brevity, only a small cross section of the top 24 is shown in the drawings.

The air gap body 12 includes an upper housing 26 having an internally threaded lower portion connected to the threaded upper extremity of the air gap body 12. In addition, the upper extremity of the upper housing 26 includes a circumferential groove 27 which slidably and resiliently accepts a complemental circumferential rib 29 of a cylindrical cap portion 28. The cap portion 28 is made of plastic material sufficiently resilient that it can be press fitted into position and held there, as illustrated.

A base 31 of the upper housing 26 snugly supports the lower end of a protective or decorative vent cap 30 which has one or more vent openings 33. The vent cap 30 includes drain passage means in the form of a passage **33*b* extending through the lower extremity of the cap 30** to drain waste water which might otherwise collect in the drain cap. Any suitable means may be employed to separably attach or mount these components together, as will be obvious to those skilled in the art.

The threaded upper extremity of the air gap body 12 is held in position within the counter top opening 23 by a nut 56 threaded onto the upper extremity and bearing up against a split spacer washer 58. Washer 58 in turn bears up against a sealing ring 60 which fits against the underside of the counter top 24.

The end extremities of the inlet ports 14 and 16 are connected to the dishwasher drawers 18 and 20 by usual and conventional dishwasher hoses 32, respectively, as indicated at 32 in FIG. 1. Any suitable means for fastening the hoses onto the ports 14 and 16 may be used. In addition, the extremities of the ports are preferably provided with molded exterior ridges 34, as seen in FIG. 8. These tightly engage the interior walls of the hose ends to provide watertight integrity. Standard hose clamps 35 may be used in addition to further ensure snug connections.

Figure 2:
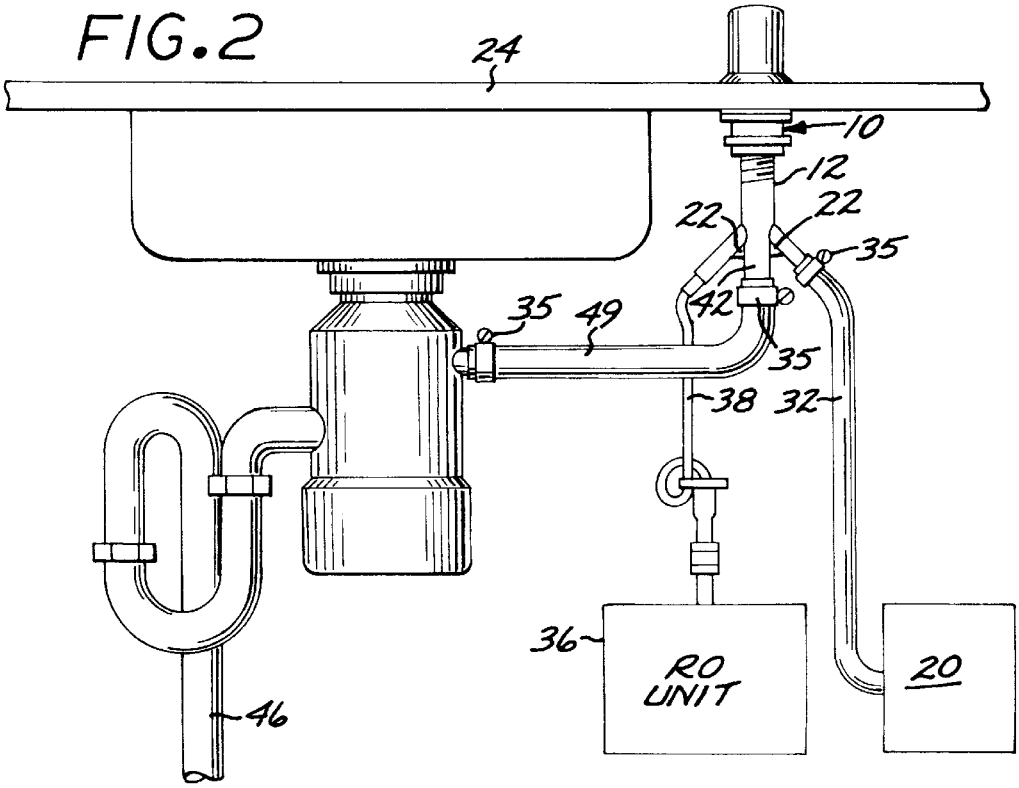
FIG. 2 is a front elevation similar to FIG. 1, but illustrating the dual air gap connected to a single dishwasher or dishwasher drawer and also to an RO unit, but with a different RO connection from that shown in FIG. 1.
Figure 9:
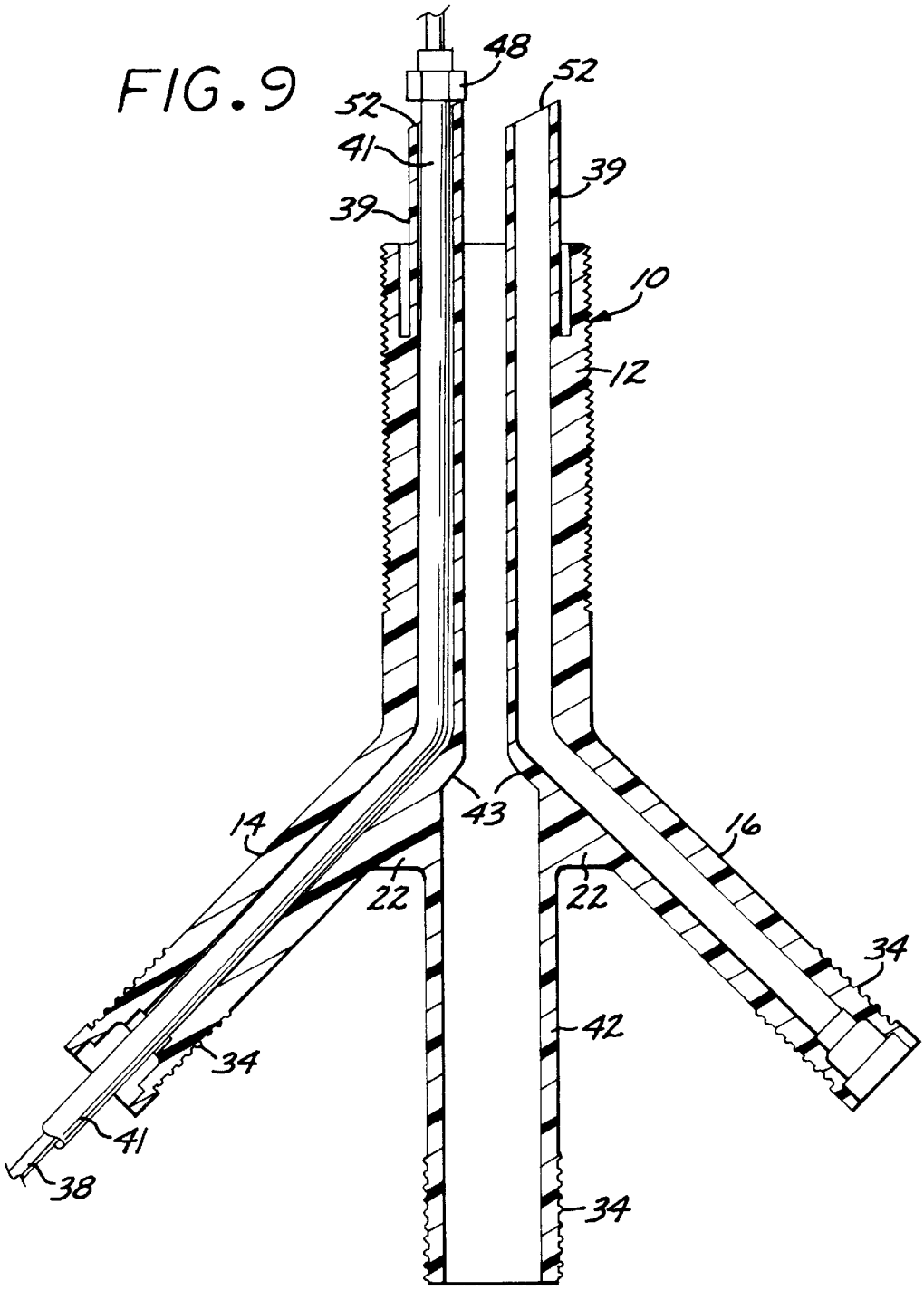
FIG. 9 is an enlarged longitudinal cross sectional view similar to FIG. 3, but illustrating the side of the air gap body of the embodiment of FIG. 2.

Although various means known in the prior art may be used for connecting the ports 14 and 16 to the dishwasher drawer hoses, the universal connections provided by hose clamps 35 or the like can be quickly and easily installed or mounted in position.

Where the ports 14 and 16 are to be connected to smaller diameter tubing, the inner walls of the ends of the ports can be provided with stepped bores, as seen in FIGS. 2 and 9, to adapt the ports for receipt of tubing of various external diameters. Any suitable quick connect fittings known in the prior art may be used to connect the tubing within the ports.

The reverse osmosis (RO) unit 36 which is diagrammatically shown discharges waste water at a relatively low flow rate. A small diameter flexible tube 38 is used to accept this flow. The tube 38 may have an outside diameter of ⅛, ¼ or ⅜ inch, and the stepped bores of the inlet conduits are dimensioned accordingly. A ⅛ inch external diameter is preferred because such a tube more easily fits within the passages and bores provided in the air gap body and associated components, as will be seen.

The present dual inlet air gap is adapted for association not only with the two dishwasher drawers 18 and 20 illustrated in FIG. 1, but also in association with one dishwasher source and one RO waste water source. FIG. 9 illustrates such an arrangement. For brevity, only the two inlet ports 14 and 16 are illustrated.

In this application a larger diameter protective tube 41 is pushed upwardly through the inlet port 14 until it projects above the upper end of the port 14. The smaller diameter RO waste tube 38 is then passed upwardly through the protective tube 41 until it projects above the upward termination of the tube 41. As will be apparent, the tube 41 may then be deformed or curved to extend into the air gap vent chamber provided in the cap portion of this embodiment.

A fitting 48 is fitted or crimped onto the upper extremity of the protective tube 41 in engagement with the upper end of the extension 39. This constrains the tubes 41 and 38 against inadvertent downward separation from the air gap body 12.

With reference to venting of dishwasher drawers 18 and 20 along with venting of the RO unit 36, one suitable embodiment is illustrated in FIGS. 3 and 8 for accomplishing this. As seen, the tube 38 extends upwardly through slots in the spacer washer 58 and in the sealing ring 60, through clearance space between the inner surfaces or walls of the counter top mounting hole 23, through guide passages and positioning openings 50 in the air gap body, and then into the vent chamber 40.

The passages and openings 50 provided in the base 31 and sides of the upper housing 26 are of relatively small diameter and spaced or positioned in such a way that when the tube 38 is trained or curved around the small radius bends and into openings 50 the tube 38 is securely held in position. As will be apparent, the nature and location of the passages and openings for the tube 38 will vary according to the requirements of the particular application.

To facilitate positioning, the tube 38 is preferably made of a slippery, low coefficient friction material such as tetrafluoroethylene. A preferred form of tetrafluoroethylene material (identified by the registered trademark "Teflon") is marketed by McMaster-Carr under the designation FEP 52355K11. It is ⅛ inch in outside diameter, has a wall thickness of approximately 0.030 inches, and can be bent or formed around small radii without any kinking that could interfere with optimum fluid flow.

As best seen in FIG. 8, the upper ends of the inlet conduit extensions 39 are cut at an angle to provide bevels 52. The waste water discharged from the upper ends impinges upon the inner surface of an upper wall 54 of the cap portion 28 and is reversely directed to flow downwardly through the air gap vent chamber 40 located just below the bottom terminus of the cap portion 28, and eventually out of the outlet conduit 42.

The bevels 52 are important for controlling the direction and character of flow of the water against the upper wall 54 and the adjacent vertical surfaces of the cap portion 28. It has been found through experimentation that the angle of the bevels 52 and their proximity to the upper wall 54 affect the rate of flow and pressure drop through the air gap body 12. As will be apparent, one skilled in the art can thus establish an optimum angle and proximity through laboratory tests to provide an optimum combination.

Waste water from the dishwasher and other waste water sources flows upwardly through the upward extensions 39 of the inlet ports, and into the air gap body 12, upper housing 26 and cap portion 28. As previously indicated, the cap portion downwardly redirects such flows so that they pass through an air gap vent chamber 40. The chamber 40 is vented to atmosphere through one or more openings in the vent cap 30, as will be seen.

The air gap body 12 also includes an integral, downwardly extending discharge or outlet port 42 which accepts the waste water flowing downwardly from the hollow interior of the air gap body, and directs it through a hose 44 to a garbage disposer, if one is present, or if not, directly into the household drainage system 46.

An important feature of the present invention is the discovery that the bevel or angle, the configuration, and the configuration and arrangement of the inlet port extensions 39 can be adjusted or selected to achieve optimum high flow and low pressure drop conditions.

In a single inlet air gap body these considerations were not so critical because the inlet port was ample to handle the combined flow from the one dishwasher, and also from one RO source.

In designing the present dual inlet air gap the challenge was to produce an air gap body which had about the same dimensions as a single inlet air gap, and was easy and inexpensive to manufacture and install, and yet had approximately the volume, rate of flow and pressure drop necessary to handle the waste flow from not just one but two dishwashers or dishwasher drawers, as well as an RO unit if desired. In addition, the separate flows from the two dish washer drawers were isolated from each other to prevent siphoning of the waste water flow from one dishwasher to the other, or to any RO unit in the system. Both waste flows are vented to atmosphere from a common air gap space or chamber.

As will be seen, the separate dish washer drawer flows were isolated from each other as much as is practical to prevent siphoning of waste water flow from one dishwasher to the other or to any RO unit in service. All such waste flows are vented to atmosphere from a common air gap space or chamber.

Figure 5:
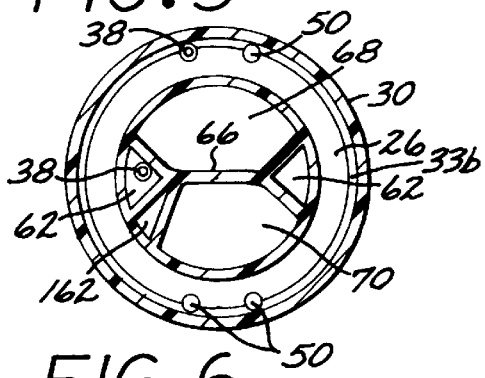
FIG. 5 is a view taken along the line 5—5 of FIG. 3.

As best seen in FIGS. 2, 3 and 5, the present dual inlet air gap is able to handle a volume and rate of flow from two or more waste sources by novel modifications of the single inlet air gap body. The transition structure 43 between each inlet port 14 and 16 and its associated inlet port extension 39 were rounded and streamline. In addition, each inlet port extension 39 was made in a tubular configuration that was molded or integrally joined to the interior surfaces of the air gap body along a longitudinal seam extending along the outer surface of the extension 39. The rounded configuration of the lower or inlet ends of the extensions 39 also now provides a draft or taper which enables easy removal of molding pins when an injection molding process is used to form the air gap body.

The upper ends of the extensions 39 are beveled or cut at an angle to establish an optimum smooth flow path for the waste water flow impinging against the upper flow reversal wall of the cap portion 28. It has been found that in some applications an optimum flow volume and rate is better established by orienting the beveled ends in confronting relation so that the respective flows are directed radially inwardly, as seen in FIG. 8. In other applications it has been found that optimum flow rates are achieved when the beveled ends are oriented to discharge tangentially or circumferentially. Still other modifications which have improved the flow rate incertain applications include making the beveled end of one extension 39 longer than the other, or making the diameter of one extension 39 larger than the other. Collectively, it has been found that these modifications have resulted in a configuration capable of passing waste water from two dishwashers at a volume and rate of flow comparable to that of a single inlet air gap, and without prohibitive pressure drops.

Figure 4:
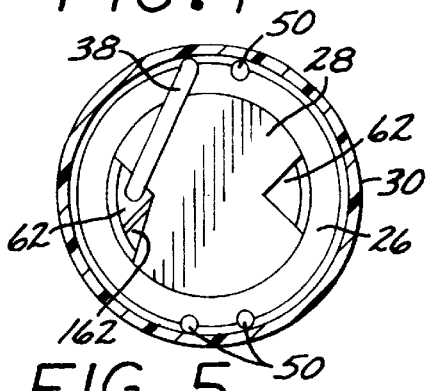
FIG. 4 is a view taken along the line 4—4 of FIG. 3.

Improved venting openings and other changes are illustrated in FIGS. 3–8. The top of the flow reversal or cap portion 28 includes seats or grooves 50, the most conveniently located one of which is chosen to receive and define the path of the waste water tube 38. The tube 38 is properly positioned for discharge into the air gap body by pulling it upwardly, bending it downwardly over the top of the cap portion, as seen in FIG. 4, and then bending it downwardly through one of a pair of oppositely located, triangularly shaped vent holes 62. The triangular shape of the holes 62 is not critical, and they may be any shape found to be best suited to the location and orientation of the tube 38 and its venting requirements.

Figure 6:
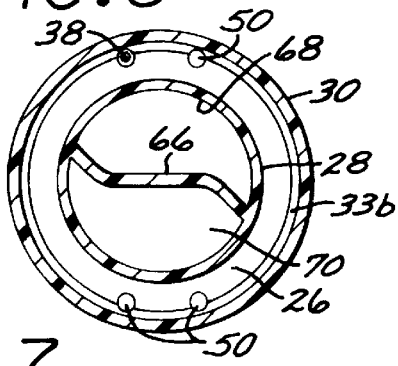
FIG. 6 is a view taken along the line 6—6 of FIG. 3.
Figure 7:
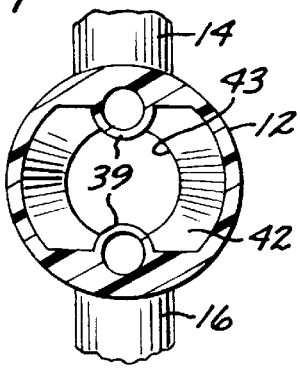
FIG. 7 is a view taken along the line 7—7 of FIG. 3.

As seen in FIGS. 5, 6 and 8, the downwardly directed tube 38 extends into one of a pair of flow chambers 68 and 70. These chambers are defined between the top wall and interior cylindrical surface of the cap portion 28, and also by a transverse partition 66 which extends between opposite sides of the cap portion. As seen in FIGS. 5 and 6, in one embodiment the partition 66 is formed in a generally serpentine or S shape which extends downwardly approximately to the threaded top of the air gap body 12. This forms the flow chambers 68 and 70 which accept the redirected, relatively turbulent water flow from the upper wall of the cap portion 28. The flows through the chambers 68 and 70 are isolated or separated by the partition 66, that is, the partition 66 extends downwardly sufficiently to prevent back siphoning of waste water between the chambers 68 and 70.

The high volume, high rate flow of a single dishwasher is normally discharged into the chamber 68. If an RO system is used, its waste flow is also directed into the chamber 68 through the tube 38 in the vent hole 62.

The walls defining the vent hole 62 for the RO tube extend downwardly a significant distance to better isolate the low flow, low volume RO waste water from the more rapidly flowing, high volume dishwasher water flow. This reduces the possibility of back siphoning of waste water into the RO tube 38.

The S shape of the partition 66 defines the triangular vent hole 62 and also a vent hole 162, the vent tube opening or hole 162 being exemplary of the ease with which additional vent holes can be provided should they be needed for other, special applications.

In this regard, it is anticipated that the operating performance of the system can be further enhanced by other alterations in the configuration, location and lower terminus of the partitions which define the various vent holes, and alterations in the top wall and cylindrical surface of the cap portion 28.

Figure 10:
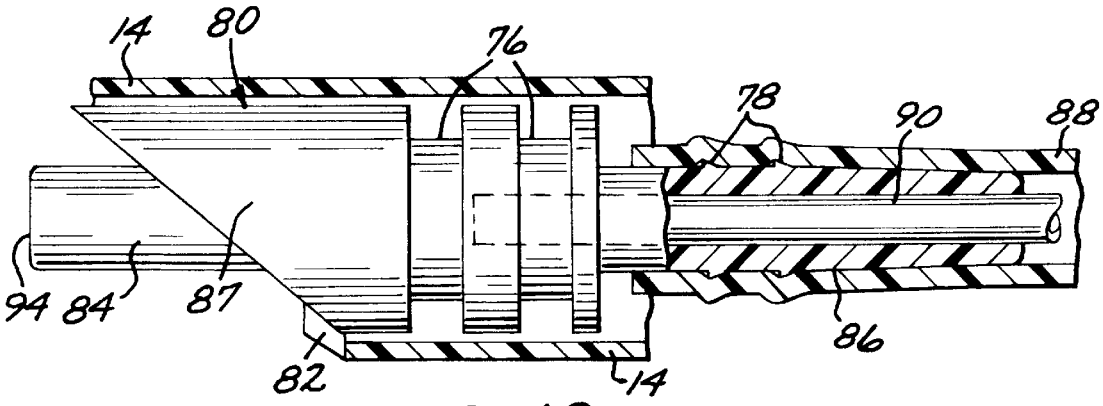
FIG. 10 is an enlarged longitudinal cross section of the upper extremity of one of the inlet ports, illustrating an upper tubing adapter inserted into the upper end of RO waste water tubing, and axially moved to a raised, projected or inoperative position.
Figure 11:
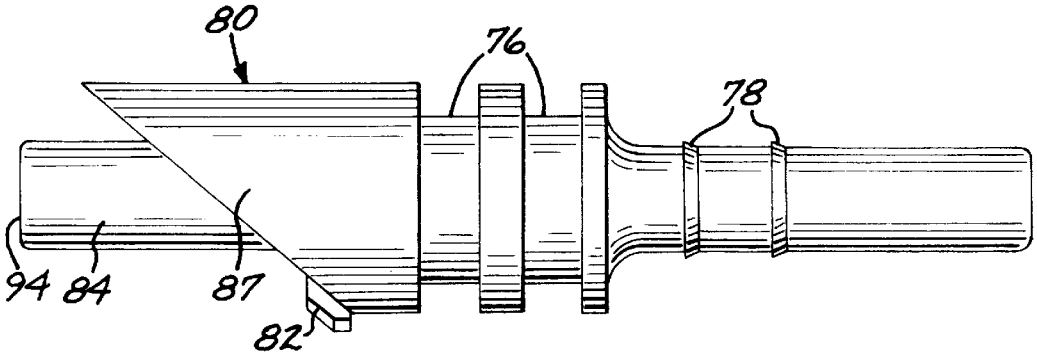
FIG. 11 is an enlarged longitudinal elevational view of the tubing adapter which is axially insertable into the inlet port, as illustrated in FIG. 10.

Referring now to FIGS. 10 and 11, a special embodiment of the present invention is illustrated which enables an air gap installer to convert the present dual inlet air gap from accepting waste flow in only one of its inlet ports to acceptance of RO waste water flow in the other inlet conduit.

An inlet port 14 is illustrated which is large enough to slidably accept an RO tube 88 in its interior. The RO tube 88 is larger in diameter than the more common RO tube but still small enough to easily slide within the port 14.

The end of the RO tube internally receives an insert end 86 of a tubing adapter 80. The insert end 86 is provided with gripping ridges 78 with prevent inadvertent separation of the tube 88 from the adapter 80.

The insert end 86 is preferably molded with a closed end to prevent RO waste water from flowing through it. Such an insert end would be used when there is no RO waste flow through the associated inlet port 14, but it is desired to quickly convert the installation to handle RO waste water flow.

This can be easily accomplished by using cutters or the like to cut off the closed end of the insert end 86. RO water will then flow into the adapter for ultimate discharge against the flow reversal wall of the cap portion 28.

A feature of the insert end 86 is that even with the end of the insert end 86 cut off, waste water can still be blocked at any time if desired. This is done by grasping the tubing 88 and sliding it upwardly through the inlet port 14 until a flat end face 94 of the adapter top 84 is projected above the inlet port 14, in engagement with the flat or planar face of the flow reversal wall of the cap portion 28. This blocks water flow through the adapter top 84.

A watertight connection is provided between the inlet port 14 and an adapter body 87 of the adapter 80. The body 87 is slightly smaller in diameter than the port 14 so that it can be inserted and closely received within the inlet port. The body 87 includes a plurality of circumferentially extending O-ring grooves or seats 76 which receive O-rings (not shown) for engagement with the inner wall surface of the inlet port. This provides a waterproof arrangement and also constrains the body 87 against axial separation from the inlet port 14.

The end of the body 87 which extends out of the inlet port 14 is beveled at approximately the same angle as the end of the port 14 so that when it is retracted within the port 14 its beveled end will be aligned with or match the beveled end of the port 14 into which it is retracted. This retains the water flow characteristics of the beveled end of the inlet port 14.

When the body 87 is retracted into the position of FIG. 10, the proper retracted position is established by engagement of a tab or stop 82 on the body 87 with a portion of the beveled end of the inlet port 14.

While preferred forms of the invention have been illustrated and described, it will be apparent that various modifications and changes can be made without departing from the spirit or scope of the invention.

What is claimed is:

1. In an air gap system for venting the waste water discharges from a pair of waste water sources which each have substantially the same high discharge volume and rate of flow which characterize a household dishwasher, a dual inlet air gap comprising:

a unitary air gap body adapted to be vertically oriented within a mounting hole in a sink top, and having a vertically extending outlet port which includes a central discharge passage;

a hollow cap portion mounted to the top of the air gap body, and having a water deflection wall in fluid communication with the central discharge passage, and further having a partition extending downwardly from the water deflection wall;

a hollow vent cap fitted over the cap portion and including vent openings for venting the central discharge passage; and a pair of elongated inlet ports which include a central bore opening into the central discharge passage of the outlet port, the inlet ports extending downwardly on opposite sides of the outlet port and terminating in lower extremities extending in divergent relation for connection to the pair of waste sources, the inlet ports extending upwardly through the central discharge passage and into the cap portion for discharging waste water from the waste water sources upwardly, onto opposite sides of the partition and against the water deflection wall for deflection downwardly into the central discharge passage, the central discharge passage being adapted for accepting the waste water from the inlet ports for discharge into a drain means.

2. An air gap according to claim 1 wherein the upper extremity of the air gap body is externally threaded, and the cap portion is cylindrical and has a circumferentially oriented larger diameter rib portion, the air gap body further comprising a cylindrical fastening means having an internally threaded lower extremity threaded onto the upper extremity of the air gap body, and further having a reduced diameter upper end portion for engagement with the rib portion whereby tightening the fastening means onto the air gap body secures the cap portion in position upon the air gap body.

3. An air gap according to claim 1 wherein the waste sources are two dishwasher drawers of a single dishwasher.

4. An air gap according to claim 1 wherein the air gap is injection molded of plastic material.

5. An air gap according to claim 4, wherein the air gap body is molded as one completed piece.

6. An air gap body according to claim 5 wherein the inlet ports, the outlet port and the adjacent portions of the air gap body have a common mold parting line so that equal portions of the inlet ports, equal portions of the outlet port and equal portions of the air gap body lie on opposite sides of the mold parting line.

7. An air gap according to claim 1 wherein the cap portion includes means defining a pair of adjacent, side-by-side flow chambers for receiving waste water discharges from two waste water sources, respectively, and further defining a pair of vent passages for venting the flow chambers to the interior of the vent cap.

8. An air gap according to claim 5 wherein the partition is attached to and extends diametrically between opposite sides of the cap portion to define the flow chambers.

9. An air gap according to claim 8 having a required plumbing code critical level indicated thereon, and wherein the partition is S-shaped and extends from the upper extremity of the cap portion downwardly to a level approximately at the critical level.

10. An air gap according to claim 9 wherein the partition is attached to the water deflection wall.

11. An air gap according to claim 10 wherein the curvature of the substantially S-shaped partition is complemental with the configuration of the upper outlet ends of the first and second inlet ports.

12. An air gap according to claim 9 wherein the upper extremities of the inlet ports are cut at an angle to control the direction and improve the flow characteristics of the waste water discharged from the inlet ports against the water deflection wall.

13. An air gap according to claim 12 wherein the upper extremities are oriented with the cut ends in confronting relation for discharge against the water deflection wall in a controlled pattern.

14. An air gap according to claim 9, and with improved outflow performance wherein the shaped partition utilizes bend radiuses that are complemental to the outside diameters of both inlet tube projections which then maximizes the available remaining cross sectional space in the central outflow chamber thereby improving outflow performance.

15. An air gap according to claim 9 wherein the curvature of the substantially S-shaped partition is complemental with the configuration of the upper outlet ends of the first and second inlet ports.

16. An air gap according to claim 1 wherein the lower extremities of the inlet ports extending into the central discharge passage are smoothly rounded to offer low resistance to upward water flow through the inlet ports and into the central discharge passage, and to downward water flow through the central discharge passage and into the outlet port.

17. An air gap according to claim 16 wherein the diameter of the outlet port adjacent the upper extremities of the inlet ports is of larger diameter than the lower extremity of the outlet port to minimize the pressure drop resulting from downward water flow through the outlet port.

18. An air gap according to claim 17 wherein the diameter of the central discharge passage diminishes incrementally and smoothly from the diameter adjacent the upper extremities of the inlet ports to the diameter of the lower extremity of the outlet port.

19. An air gap according to claim 1 and including bracing means extending between the inlet ports and the outlet port.

20. An air gap according to claim 1 wherein one of the inlet ports is adapted for connection to a first waste water source, and the other inlet port includes a protective tube extending from the inlet port to the upper extremity of the other inlet port, and including a reverse osmosis waste discharge tube disposed upwardly through the protective tube and adjacent the end portion of the associated inlet port.

21. An air gap according to claim 20 and including crimping means on the protective tube adjacent the upper extremity of the inlet port to constrain the protective tube and the waste discharge tube from movement relative to the inlet port.

22. An air gap according to claim 1 wherein one of the pair of inlet ports constitutes a first inlet port adapted for connection to a first waste water source; a cylindrical upper tubing adapter axially slidable within the first inlet port, and having a central bore, a beveled outlet end, an adapter top projecting out of the outlet end and having an end face for engagement with the water deflection wall to prevent water flow through the bore, and further having both a mechanical gripping and pressure sealing inlet end for coupling to a reverse osmosis waste discharge tube; the other of the pair of inlet ports having a beveled outlet end; the adapter body further having a projected position in which the end face of the end element engages the water deflection wall to block any undesirable backflow water through the central bore, the adapter body being receivable in substantially fluid tight relation within the other inlet port, with the bevels of the adapter body outlet end and the inlet port substantially in alignment, the tubing adapter being slidable within the other inlet port for movement into the projected position, and for movement into a retracted position to enable forward water flow through the central bore.

23. An air gap according to claim 22 and including a stop means operative to prevent inward axial movement of the tubing adapter downwardly beyond the retracted position.

24. An air gap according to claim 1 wherein one of the pair of inlet ports constitutes a first inlet port adapted for connection to a first waste water source, the first inlet port having a beveled outlet end, and the other of the inlet ports constitutes a second inlet port having a beveled outlet end, the air gap further comprising a centrally bored cylindrical upper tubing adapter having a beveled outlet end and axially slidable within the second inlet port between projected and retracted positions, the tubing adapter having an end face engageable with the water deflection wall in the projected position to prevent undesirable back flow of water through the bore of the tubing adapter, the tubing adapter further including an insert end adapted for fluid tight, mechanically secure coupling to a reverse osmosis waste tube to admit forward flow of reverse osmosis waste water into the bore of the tubing adapter.

25. An air gap according to claim 24 and including a travel limit stop means operative to prevent inward axial movement of the tubing adapter downwardly beyond the retracted position.

26. An air gap according to claim 24 and including a travel limit stop means on the tubing adapter engageable with the end extremity of the second inlet port in the retracted position to fix the retracted position of the tubing adapter when the beveled outlet ends of the tubing adapter and the second port are in substantial coincidence.

27. An air gap body according to claim 24 for association with a household sink, wherein the air gap body includes externally located pathways adapted to externally mount a vent tube originating from below the sink for venting into the interior of the hollow cap portion at a point above the critical level specified by plumbing codes.

28. An air gap body according to claim 1 wherein the air gap body includes a plurality of openings and passages to carry a reverse osmosis waste water tube for emptying into the interior of the cap portion.

29. An air gap body according to claim 1 wherein the inlet end of at least one of the inlet ports includes a counterbore for receiving a press in fitting to accommodate various sizes of reverse osmosis waste water tubing.

30. An air gap according to claim 1 wherein the hollow vent cap further includes drain passage means for drainage of any waste water which might otherwise collect in the vent cap.

* * * * *